United States Patent [19]

LaFleur et al.

[11] Patent Number: 4,481,006

[45] Date of Patent: Nov. 6, 1984

[54] BAG MAKING METHOD AND MACHINE

[75] Inventors: Arthur E. LaFleur; Lee LaFleur, both of Manistee, Mich.

[73] Assignee: Custom Packaging Systems, Inc., Manistee, Mich.

[21] Appl. No.: 331,135

[22] Filed: Dec. 16, 1981

[51] Int. Cl.[3] ..... B31B 23/14

[52] U.S. Cl. ..... 493/194; 493/204; 493/925

[58] Field of Search ..... 493/204, 203, 193–196, 493/209, 206, 925

[56] References Cited

U.S. PATENT DOCUMENTS

| | | | |
|---|---|---|---|
| 3,257,915 | 6/1966 | Cartier et al. | 493/196 |
| 3,805,683 | 4/1974 | Hook | 493/204 X |
| 3,863,549 | 2/1975 | Melin et al. | 493/204 X |
| 4,166,412 | 9/1979 | Versteege | 493/203 X |
| 4,371,365 | 2/1983 | Shingo | 493/204 X |
| 4,395,254 | 7/1983 | Schuster | 493/196 |

*Primary Examiner*—James F. Coan

*Attorney, Agent, or Firm*—Barnes, Kisselle, Raisch, Choate, Whittemore & Hulbert

[57] ABSTRACT

A length of woven plastic fabric in tubular form is advanced from a source of supply while telescoped over a separator plate which maintains the two plies of the tubular stock in separated relation. A heated knife blade aligned vertically with the downstream end of the separator plate is reciprocated vertically to sever the tube stock into bag blanks. The severed edges on the upstream side of the heated knife remain separated rather than being heat sealed together by the heated blade. The severed blank is impaled on needles mounted on an endless chain which conveys the blanks laterally through a sewing machine and/or a sealing mechanism for securely closing one end of the blanks. Thereafter successive blanks are conveyed to a stacking device which disengages the blanks from the needle chain and stacks them horizontally one upon another.

30 Claims, 10 Drawing Figures

Fig-3
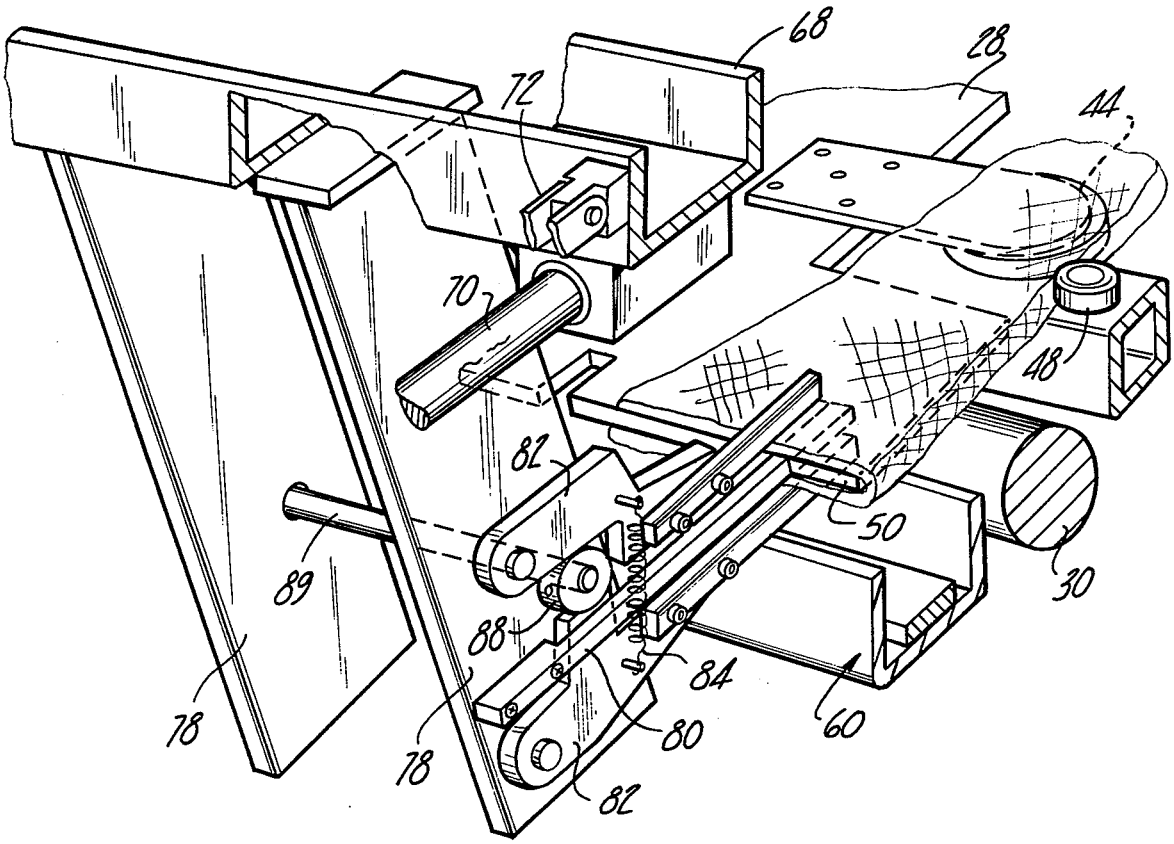
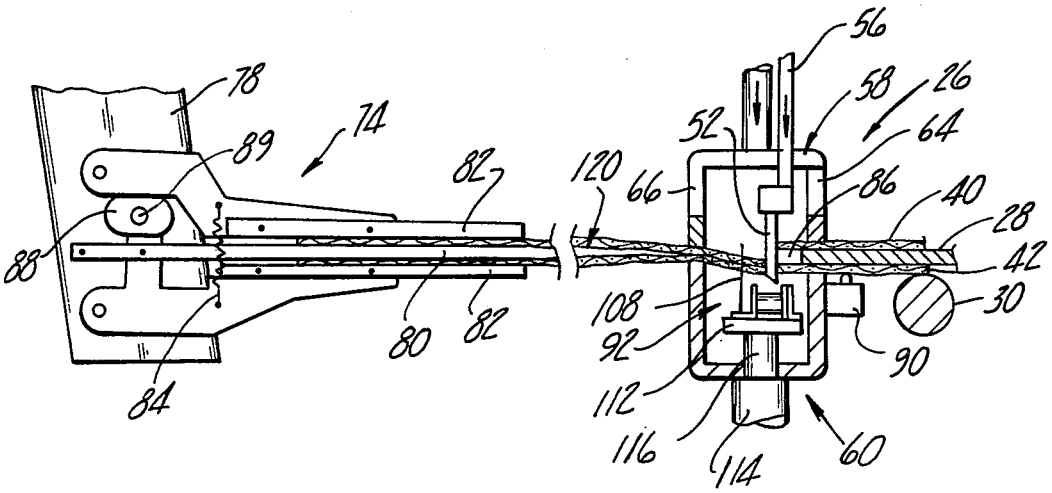
Fig-5

BAG MAKING METHOD AND MACHINE

This invention relates to an apparatus and method for making bags and, more particularly, to a method and apparatus for making bags from flat tubular stock in the form of woven plastic fabric.

In the manufacture of bags from woven plastic fabric the material is normally supplied in the form of a continuous length of flat tubular fabric. In the course of manufacture the tubular stock is cut to length to form bag blanks having one end closed and the other end open for filling the bag. Cutting the woven tubular stock to bag length by shears or knife blades is impractical because the threads or ribbons at sheared edges will fray and unravel. Therefore, woven plastic fabric is normally heat cut so that the strands of plastic at the cut edges will be fused together. One of the problems encountered in heat cutting plastic tubular stock is that the severed edges of the two plies of stock on both sides of the heated cutter become at least partially heat sealed or fused together. Thus, the trailing end of one bag blank and the leading end of the next successive bag blank are both at least imperfectly closed by heat sealing. A separate operation is therefore required to break or open one heat seal on each bag; that is, to separate the heat sealed edges at one end of each blank so as to provide an open end for filling the bag.

The heat seal resulting from the heat cutting is usually an imperfect one and, consequently, after the blank is cut to length it is usually indexed laterally so that the bottom end of the bag may be more perfectly closed as by stitching. This is normally accomplished by conveying the bag laterally on a conveyor belt through the sewing machine after which the bags are stacked one upon another so as to be ready for delivery or use. In the manufacture of waterproof bags the woven tubular fabric encloses a tubular sheet plastic liner which is heat sealed at each end of the bag. The mechanism for laterally conveying the bag blanks and for stacking them after the bottom end is sewn and heat sealed is not only cumbersome and costly, especially when the bottom end of the bag is guided through a sewing machine, but also tends to produce a slower than desired production rate because of several unavoidable problems, such as the necessity of synchronizing the operation of various separate mechanisms.

The primary object of the present invention is to provide a method and apparatus for manufacturing bags, particularly plastic bags, which avoid the problems encountered with the above-described method and apparatus.

A more specific object of this invention is to provide a method and apparatus for heat cutting tubular plastic bag stock such that the two plies of the blank at only one side of the line of cut become fused or sealed together.

Another object of this invention is to heat cut plastic tubular bag stock by advancing flat tubular stock to a heat cutter with a separator plate between the two plies of the tubular stock that extends to directly adjacent the line of cutting so that along at least one side of the line of cutting the edges of the superimposed plies of the tubular stock are maintained in a separated condition.

Another object of this invention is to convey bag blanks laterally after being cut to length by engaging them with a series of needles on a laterally moving conveyor.

A further object of the invention is to transport bag blanks laterally while vertically suspended from a chain-supported series of needles.

Another object of the invention resides in the provision of a simple mechanism for vertically disengaging bag blanks suspended from a needle chain to enable the vertically oriented blanks to be stacked horizontally upon one another.

Other objects, features and advantages of the present invention will become apparent from the following description and accompanying drawings, in which:

FIG. 3 is a fragmentary perspective view showing the stock advancing mechanism;

FIG. 5 is a fragmentary sectional view, partly in section, showing the heat cutter and needle chain conveyor;

Figure 1:
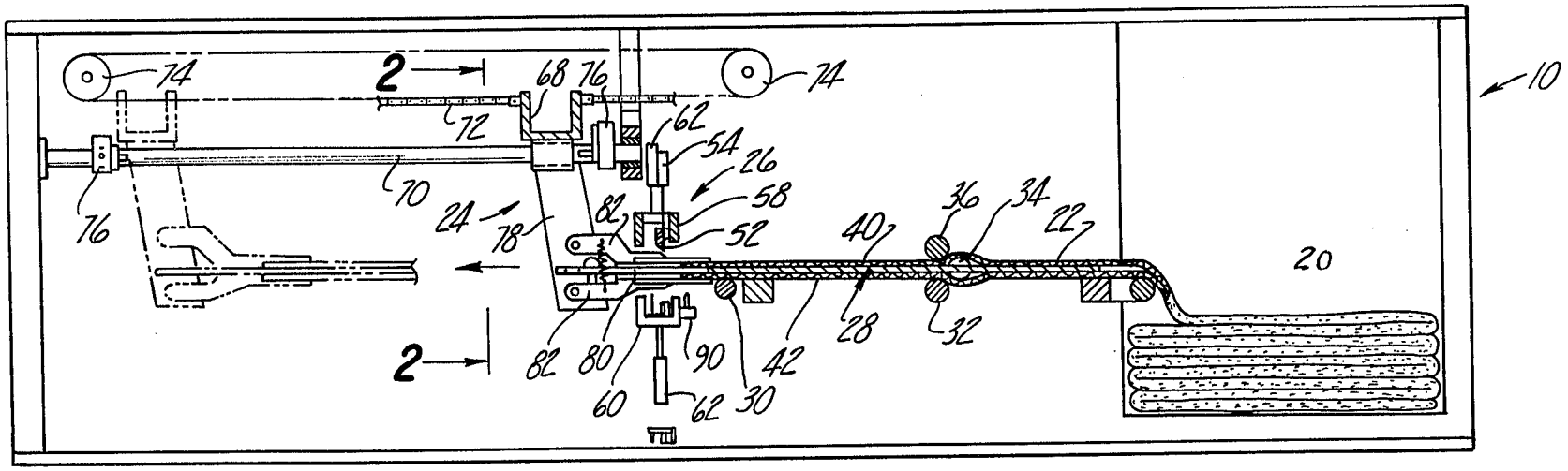
FIG. 1 is a somewhat diagrammatic view of a heat cutting and stock advancing mechanism according to the present invention.
Figure 4:
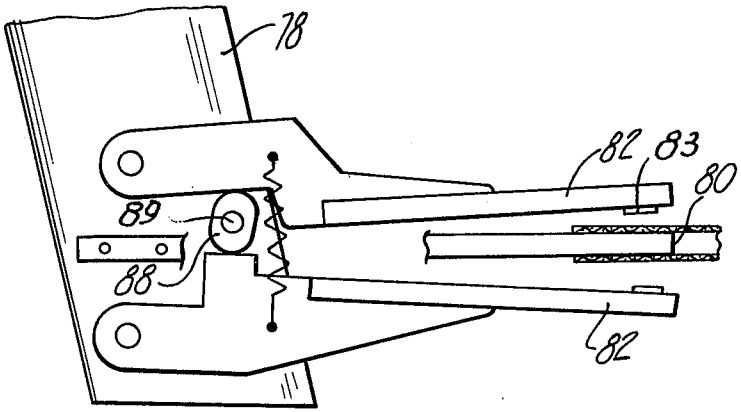
FIG. 4 is a fragmentary side elevational view of the stock advancing mechanism.
Figure 2:
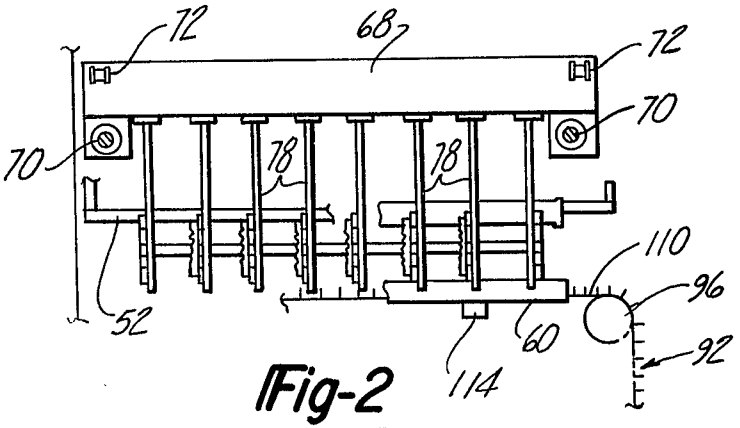
FIG. 2 is a sectional view along the line 2—2 in FIG. 1.

Referring to the drawings, the bag making machine illustrated includes a generally upright structural frame 10 on which the various components of the machined are mounted. For example, at one end of the frame 10 there is provided an accumulator box 20 for storing a long length of the tubular fabric stock, such as woven polypropylene. Accumulator box 20 is merely one example of supplying a continuous length of tubular stock to the bag making apparatus. The flat tubular stock, which is generally designated 22, is adapted to be intermittently advanced through the machine in a generally horizontal path by a feed mechanism 24 and cut into successive blanks by an intermittently-operated cut off mechanism 26. As the tubular stock 22 is progressively fed from box 20 it advances in a downstream direction toward cut off mechanism 26 while telescoped over a horizontally disposed separator plate 28.

Figure 6:
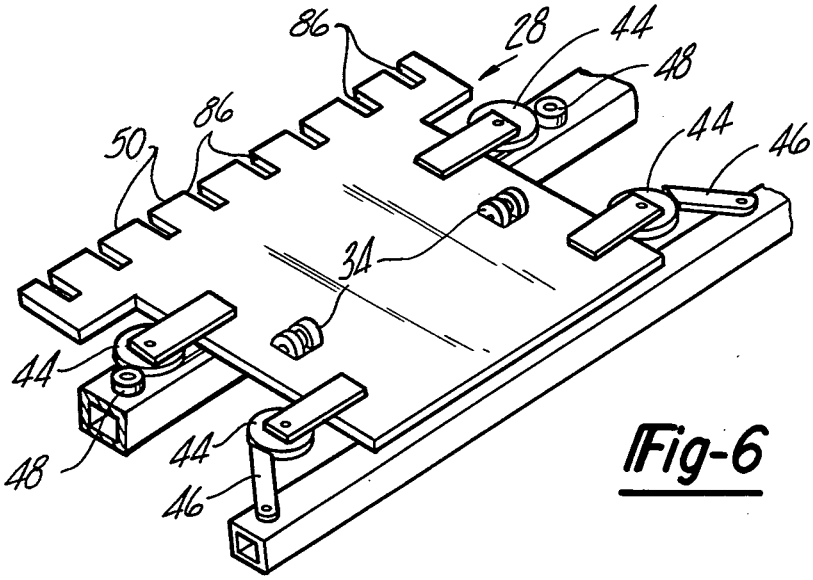
FIG. 6 is a perspective view of the separator plate.
Figure 8:
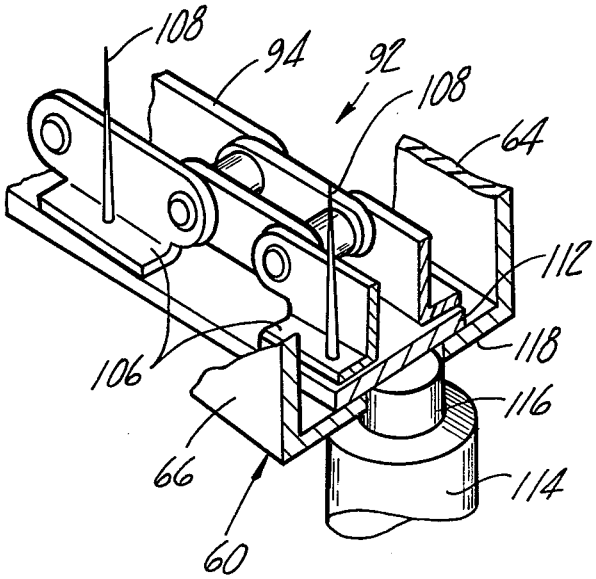
FIG. 8 is a fragmentary perspective view of the needle chain conveyor.

Separator 28 (FIG. 6) is generally rectangularly shaped and is supported horizontally on a pair of rollers 30,32 which are journalled on frame 10. The central portion of plate 28 has two pair of transversely aligned rollers 34 mounted thereon in a manner such that the rollers project from both the top and bottom faces of the plate. On the underside of the plate 28 rollers 34 are engaged by roller 32 and on the top side of the plate 28 rollers 34 are engaged by a roller 36. Rollers 32, 34,36 are so arranged as to prevent separator plate 28 from shifting forwardly on frame 10. The flat tubular stock 22 is threaded over plate 28 such that the upper ply 40 overlies the top face of plate 28 and is threaded between rollers 34,36 and the lower ply 42 underlies the bottom face of plate 28 and is threaded between rollers 32,34. In order to faciliate the movement of the tubular stock 22 past plate 28 the plate is also preferably provided with a plurality of laterally projecting rollers 44 adapted to engage the laterally opposite edges of stock 22 at the inner sides thereof. Rollers 44 are preferably arranged as two pair spaced longitudinally of plate 28 on opposite sides thereof. The rear rollers 44 are arranged to be engaged by pivoted latches 46 on frame 10 to prevent movement of the plate in a rearward or upstream direction on the frame and the forward pair of rollers 44 are adapted to be engaged by guide rollers 48 (FIG. 3) located externally of the tubular stock 22 for preventing lateral movement of plate 28.

Separator plate 28 is supported on frame 10 so that its forward or downstream end 50 is transversely aligned with a heated knife blade 52 (FIG. 5) of cut off mechanism 26. The heated knife blade 52 is arranged to be reciprocated vertically by any suitable means. In the embodiment illustrated these means are illustrated diagrammatically as a pair of fluid cylinders 54, the knife bar 52 being secured at each end thereof to the lower ends of piston rods 56 associated with cylinders 54.

Cut off mechanism 26 also includes opposed upper and lower U-shaped clamps 58,60 adapted to be reciprocated vertically toward and away from each other by any suitable means, such as fluid cylinders 62. As is clearly shown in FIG. 5, the upstream legs 64 of clamps 58,60 are adapted to clamp the upper and lower plies 40,42 of the flat tubular stock 22 against the top and bottom faces of the plate 28. The downstream legs 66 of the clamps are adapted to clamp the two plies of the flat tubular stock together along a line spaced downwardly from the heated cutting knife 52.

The feed mechanism 24 includes a transversely extending carriage 68 (FIGS. 1 and 3) mounted for longitudinal sliding movement on guide bars 70. Carriage 68 is connected to a chain 72 trained around sprockets 74, one of which is motor driven. The stroke of carriage 68 on guide bars 70 is controlled in any suitable manner, such as by limit switches 76 adjustably mounted on guide bars 70 and adapted to be engaged by the carriage at the opposite ends of its stroke. A plurality of depending arms 78 are mounted on carriage 68 in laterally spaced relation. Each arm has a stationary, horizontally extending finger 80 (FIG. 3) mounted thereon and also upper and lower fingers 82 pivotably mounted thereon. Fingers 80,82 are aligned in a vertical plane and fingers 82, provided with gripping pads 83, are normally biased by a spring 84 towards each other into engagement with the stationary finger 80.

The downstream end portion of separator plate 28 has a plurality of longitudinally extending notches 86 formed therein. The stationary fingers 80 on carriage 68 are aligned longitudinally and horizontally with notches 86. The fingers 82 of each set are adapted to be separated against the bias of spring 84 by an eccentric cam 88. Cams 88 are mounted on a common shaft 89 journalled on the depending arms 78. Suitable means (not illustrated) are provided for rotating shaft 89 to open or separate fingers 82 as the carriage reaches the end of its advance stroke remote from plate 28 and to close the fingers and thus grip the leading end of the tubular stock 22 at the start of its advance stroke wherein the free ends of the stationary fingers 80 are disposed within the notches 86 in plate 28.

The operation of the stock feed mechanism 24 and the cut off mechanism 26 is synchronized such that, when the retraction stroke of the carriage is initiated (the carriage starts moving towards plate 28), fingers 82 are separated and, before the carriage is retracted to a position wherein the stationary fingers 80 are positioned within the notches 86 of plate 28, clamps 58,60 are separated to permit entry of the fingers therebetween. As the carriage begins its advance stroke, fingers 82 close on fingers 80 thus clamping the upper and lower plies of the flat tubular stock 22 against the fingers 80 so that, when the carriage advances, a predetermined length of the stock 22 is advanced over plate 28. When the carriage reaches the end of its advance stroke, clamps 58,60 close and thereby retain the stock 22 in a taut condition between the clamped portions thereof. After the stock is so clamped, cylinder 62 is actuated by any suitable means, such as a switch 90 on clamp 60, so that the heated knife blade 52 descends and severs the upper and lower plies 40,42 of the stock along the forward edge 50 of plate 28. Since the upper and lower plies 40,42 of the woven plastic web on the upstream side of heated knife blade 52 are separated by plate 28, the severed strands of the woven fabric will be fused but the two plies will remain separated as the knife blade 52 descends therethrough. On the other hand, since the two plies of the stock are not maintained in a separated condition on the downstream side of knife blade 52, then it is likely that the heat severing action of blade 52 will not only fuse the woven strands, but also cause the two plies of the downstream side of the blade to become at least partially heat sealed together. After the stock is so severed, clamps 58,60 separate, the bag blank severed from stock 22 is advanced laterally by the hereinafter described needle chain 92 and carriage 68 is again advanced to grip the leading end of the stock around plate 28.

As pointed out above, after the stock is severed by the cut off mechanism 26, clamps 58,60 separate and the severed bag blank is conveyed laterally. The means preferably employed for conveying the blank laterally comprises a needle chain 92 which consists of a series of pivotally connected links 94 extending in an endless path around a series of sprockets 96,98,100,102, 104. The alternate links are formed with flanges 106 from which needles 108 project vertically. The upper run 110 of needle chain 92 extends longitudinally through the lower U-shaped clamp 60 and is supported on a rail 112. On the underside of clamp 60 there is mounted, adjacent the opposite ends thereof, a pair of solenoids 114 having vertically reciprocable plungers 116 extending through the bottom wall 118 of clamp 60. Solenoids 114 are controlled by suitable switches, such as the switches 90 on clamp 60, to lift rail 112 after the clamps 58,60 close and before knife blade 52 descends to sever the bag blank. When rail 112 is lifted within clamp 60 (FIG. 5) the needles 108 are caused to penetrate through the two plies of the stock on the downstream side of the line of cut of knife 52. Thus, after the stock is severed and clamps 58,60 separate the upstream end of the bag blank, generally designated 120 in FIG. 5, is impaled on the needles 108. Therefore, since the downstream end of the bag blank 120 has been released by the fingers 80,82, the bag blank 120 will hang vertically downwardly from needles 108 so as to be capable of being conveyed laterally in a generally vertically oriented position.

Although it is necessary to raise rail 112 only slightly to cause the stock to become impaled on needles 108, if desired, sprocket 96 can be pivotally supported as by a link 122 biased by a spring 123 to provide the necessary slack in the needle chain to accommodate for the raising and lowering of rail 112.

One of the chain sprockets is motor-driven at predetermined intervals for predetermined periods so as to index each bag blank 120 laterally after it has been severed. Downstream of the severing mechanism in the path of travel of the needle chain there is preferably arranged a sewing machine 124 along the top run 110 of the chain for stitching together the two plies of the bag which may have been imperfectly heat sealed by the heated knife blade 52. Stitching of the two plies of the bag blank together in this manner is desirable where the stock is a woven plastic fabric of the type commonly used for forming bags adapted to sustain heavy loads. If desired, and especially if the bag stock is provided with an impervious polyethylene liner 125 which has a substantially lower sealing temperature than polypropylene, the bag blank is also advanced through a pair of heat sealing rolls 126 for forming a waterproof heat seal along the lower end of the liner without affecting the integrity of the woven fabric bag. The stitch line and the line of heat sealing may coincide as indicated at 128 in FIG. 9 or the heat seal may extend along a line slightly above the stitch line.

Figure 9:
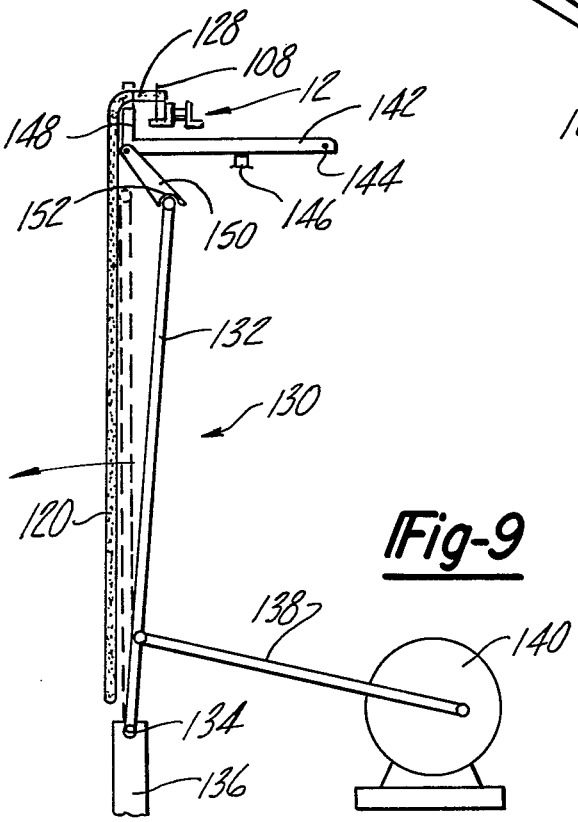
FIG. 9 is a side elevational view of the bag stacking mechanism.
Figure 10:
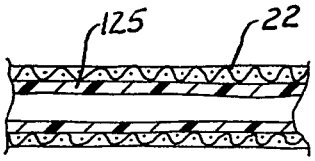
FIG. 10 is a fragmentary sectional view of the woven plastic fabric tube with a sheet plastic liner.
Figure 7:
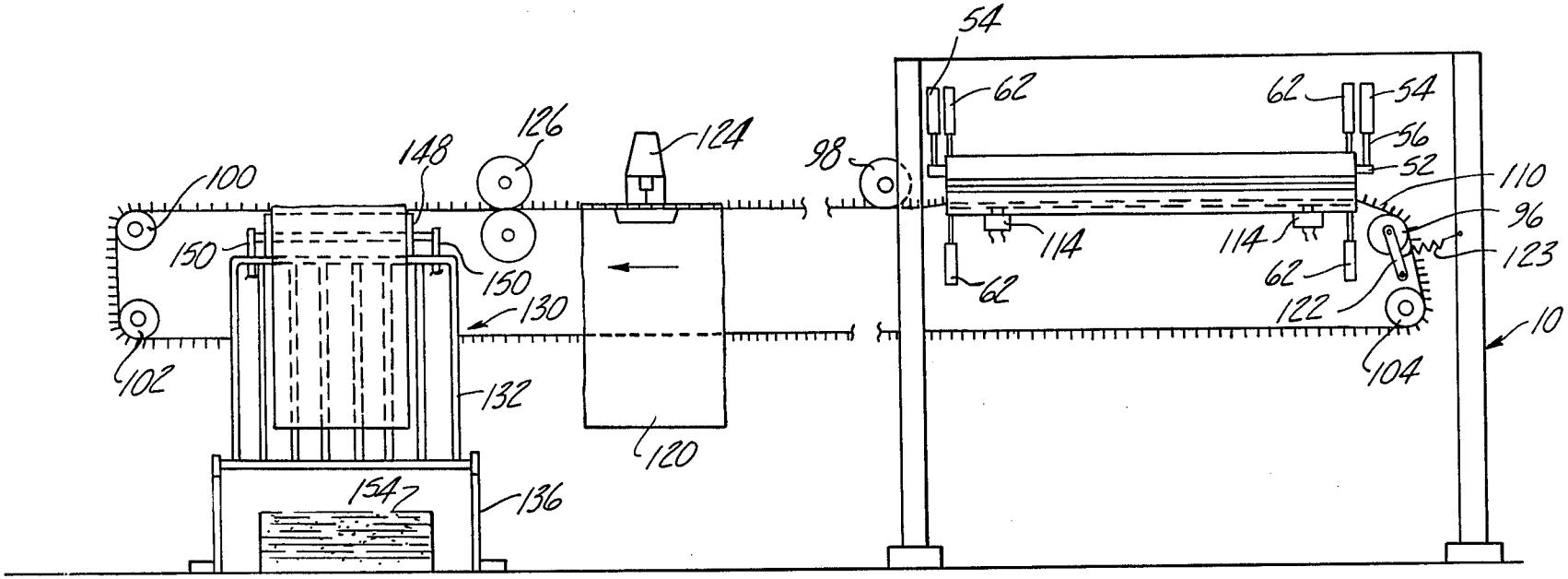
FIG. 7 is a somewhat diagrammatic view illustrating the manner in which the bag blanks are conveyed from the heat cutter, through a sewing machine and to a stacking device.

At a location downstream of sewing machine 124 and heat sealing rolls 126 it becomes necessary to disengage the bag blank from the needle chain so that the successive blanks can be stacked flat upon one another. In the present arrangement this is readily accomplished by means of a stacker mechanism 130. The stacker mechanism, the details of which are shown in FIG. 9, includes a flat open frame 132 of rectangular shape which is pivotally supported along one edge thereof as at 134 on upright brackets 136. Frame 132 is arranged to be pivotally actuated from a generally upright position (shown in solid lines in FIG. 9) to a generally horizontal position by means of a crank link 138 driven by a motor 140. An L-shaped arm 142 is pivotally supported as at 144 beneath needle chain 92 and normally rests on a stop 146. The free end of arm 142 is formed with an upright hand 148 which, when arm 142 rests on stop 146, is located just slightly below the needles 108 on chain 92. At each end thereof arm 142 pivotally supports a pair of depending links 150 formed with generally U-shaped notches 152 at the lower ends thereof. The length of links 150 and the height of frame 132 are proportioned such that, as frame 132 is pivoting upwardly from a horizontal position (clockwise as viewed in FIG. 9), when it reaches an upright position it engages the freely suspended links 150 and, as the frame continues to the solid line position illustrated in FIG. 9, it swings links 150 to the position illustrated wherein the upper end of frame 132 engages within notches 152. Thereafter, as frame 132 pivots toward the horizontal position, it swings links 150 to an upright position and causes the hand 148 to displace the upper end of the bag blank 120 upwardly and thereby disengage it from needles 108. Then, as the frame 132 continues its swinging movement toward the horizontal position, it releases links 150 and engages the vertically extending bag blank 120 and swings it into a horizontal position so that the successive blanks are stacked vertically one upon another as indicated at 154 in FIG. 7.

Thus it will be seen that the method and apparatus disclosed herein has distinct advantages with respect to present methods and apparatus for the manufacture of bags, especially plastic bags. It will be noted, for example, that, when the feed mechanism 24 advances a predetermined length of the tubular stock 22, the stock is in a taut condition since the upper and lower plies are threaded between rollers 32,34,36. After the stock is fully advanced and before it is released from between fingers 80,82, the clamps 58,60 engage the stock. Solenoids 114 are energized to impale the stock on needles 108 and then the heated knife 52 severs it along the leading edge 50 of separator 28 so that the severed edges of the stock on the upstream side of knife 52 remain separated while the edges of the two plies on the downstream side of the heated knife blade are at least imperfectly heat sealed together. After the stock is engaged by clamps 58,60, its leading end is released by fingers 80,82 so that the severed bag blank will be suspended vertically from the needles. By the time the needle chain 92 has advanced the severed bag blanks 120 laterally beyond separator plate 28, the carriage 68 with the fingers 82 open has returned to a position wherein the stationary fingers 80 have advanced into the slots 86 at the downstream end of separator plate 28. Thereafter, eccentric cams 88 are actuated to permit the fingers 82 to clamp the two plies of the stock against the stationary fingers 80, at which time the carriage is driven by the chains 72 to again advance the desired predetermined length of the tubular stock 22.

As pointed out previously, the bag blanks 120 are conveyed laterally by the upper run 110 of needle chain 92 through the head of a sewing machine 124, and also between sealing rolls 126 if a waterproof liner is employed, so as to secure the two plies of the tubular stock together at the closed end of the bag. The line of stitching and sealing is spaced slightly above the needle-impaled portion of the bag blank as indicated at 128 in FIG. 9. After the vertically suspended bag blanks are securely closed at one end the stacker mechanism disengages them from the needle chain and stacks them horizontally one upon the other.

We claim:

1. The method of making bags from flat tubular woven plastic web stock adapted to be fused by heating and which is advanced longitudinally in one direction on a support, said method including the step of severing the stock transversely by means of a heated element extending transversely of the stock at a fixed location on the support, said heated element being reciprocable in a direction perpendicular to the plane of the stock to sever the trailing end of one bag from the leading end of the next successive bag as the stock is intermittently advanced, said severing step comprising arranging a separator plate having a width corresponding to the width of the flat tubular stock on said support so that the leading end of the plate is at all times located directly adjacent and generally parallel to the line of severing produced by the heated element, telescoping the leading end of the tubular stock over the trailing end of the plate so that the two plies of the tubular stock are spaced apart a distance corresponding to at least the thickness of the plate, intermittently advancing the stock in a downstream direction to a position wherein the desired line of severing between the two bags is aligned directly adjacent the leading end of the separator plate and then reciprocating the heated element past the separator plate and through the two plies to sever the spaced apart plies of the stock directly adjacent the leading end of the separator plate and thereby retain the plies at the leading end of said next bag in said separated condition.

2. The method called for in claim 1 wherein the stock is advanced in a generally horizontal plane and the separator plate lies in said horizontal plane.

3. The method called for in claim 2 including the step of impaling a section of the tubular stock downstream from the leading end of the plate on a row of laterally spaced and vertically upwardly extending needles after the stock has been advanced in said downstream direction and then, after the stock is severed, conveying said needles with the severed stock impaled thereon in a direction transversely of the plate.

4. The method called for in claim 3 including the step of progressively securing together the two plies of the severed section of the stock at the upstream end thereof while the stock is impaled on said needles and being advanced in said transverse direction so as to form a closed bottom end of the bag.

5. The method called for in claim 1 including the step of maintaining the tubular stock in a longitudinally tensioned condition when the heated element is reciprocated through the two plies of the stock to thereby prevent the two plies at the leading end of said next bag from being passed into contacting relation by said heated element.

6. The method called for in claim 5 including the step of clamping the two plies of the tubular stock together adjacent and on the downstream side of said line of severing.

7. The method called for in claim 5 including the step of applying clamping pressure to the two plies on longitudinally opposite sides of said line of severing.

8. The method called for in claim 7 including the step of maintaining the two plies of the tubular stock in a generally longitudinally taut condition between the clamped sections thereof while being severed.

9. The method called for in claim 4 wherein said plies are secured together by stitching.

10. The method called for in claim 4 wherein the plies are secured together by heat sealing.

11. The method called for in claim 4 including the step of permitting the severed sections of the stock to hang vertically downwardly from said needles while being conveyed laterally.

12. The method called for in claim 11 including the step of moving the needle-impaled end portion of the severed sections of tubular stock vertically upwardly relative to the needles to disengage the sections from the needles after the closed end of the bag is formed and simultaneously swinging said sections from a vertical plane downwardly into a horizontal plane to stack the successive bags horizontally upon one another.

13. In a machine for making bags from a continuous length of flat tubular web stock the combination comprising, means for advancing the tubular stock longitudinally in a generally horizontal path, a cutter intermittently operable to cut the stock transversely into successive bag blanks of predetermined length, a flexible element arranged to travel in an endless path, at least a portion of which is adjacent and downstream of the line of cut of said cutter relative to the longitudinal path of travel of the tubular stock, a plurality of vertically disposed needles on said flexible element, the needles on said portion of the flexible element being oriented so that they point vertically upwardly and means for moving said portion of the flexible element and the adjacent transversely extending portion of the tubular stock vertically relative to each other for causing said portion of the tubular stock to be impaled on said needles.

14. The combination called for in claim 13 wherein the means for advancing the stock comprises means for releasably gripping the leading end of the stock and pulling it in a downstream direction in said longitudinal path, said advancing means being adapted to release the stock after it is impaled on the needles so that the portion of the stock advanced downwardly beyond the cutter will form bag blanks when the cutter severs the stock and the bag blanks will be suspended vertically downwardly from the needles.

15. The combination called for in claim 14 including means for driving the flexible element in a direction transversely of said longitudinal path to convey the vertically suspended blanks in said transverse direction.

16. The combination called for in claim 15 including means downstream from the cutter in the path of travel of the flexible element for securing the two plies of the impaled end portion of the blank together to form a closed end on the bag.

17. The combination called for in claim 16 including stacker means positioned adjacent the path of travel of the flexible element and located downstream from the cutter in said last-mentioned path of travel for disengaging the blank from the needles and substantially simultaneously therewith transposing the blanks from a vertically to a horizontally oriented position.

18. The combination called for in claim 17 wherein said disengaging means comprises means for moving the needles and the portion of the bag impaled thereon vertically relative to each other.

19. The combination called for in claim 17 wherein said stacker means includes a generally vertically extending arm supported at its lower end for pivotal movement about a horizontal axis generally parallel to the path of travel of said flexible element, means for pivoting said arm from said generally vertically extending position to a generally horizontally extending position, a vertically shiftable member disposed below and adjacent the path of travel of said needles and means operative when said arm is pivoted from said vertical position to said horizontal position for shifting said lift member upwardly to displace the upper end portion of the bag blanks vertically upwardly and out of engagement with said needles.

20. In a machine for making plastic bags from a continuous length of flat tubular woven plastic web stock, the combination comprising, a support, means for intermittently advancing the tubular stock longitudinally in a predetermined path on said support, a heated element extending transversely of the path of travel of the tubular stock at a fixed location on said support, means for reciprocating the heated element transversely of the plane of the stock to engage and sever the stock to bag blanks of predetermined length, a generally flat separator plate arranged within the tubular stock such that one ply of the tubular stock overlies one face of the separator plate and the other ply of the tubular stock overlies the other face of the separator plate and means for supporting the separator plate such that the leading end thereof extends at all times along a line closely adjacent the line of severing produced by the heated element whereby, when the heated element is reciprocated, the stock is severed and the severed edges of the two plies at the upstream side of said line of severing are maintained in separated, spaced-apart relation by said end of the separator plate.

21. The combination called for in claim 20 including means for retaining the stock in a longitudinally taut condition on the upstream and downstream sides of said line of severing.

22. The combination called for in claim 21 wherein said retaining means comprises clamp members for clamping the two plies of the stock against the opposite faces of the separator plate along a transverse line adjacent said leading end of the plate.

23. The combination called for in claim 20 wherein the plate is supported in a generally horizontal plane and including a flexible element travelling in an endless path, a portion of which extends transversely of said plate and adjacent and beyond the downstream end thereof, a plurality of vertically disposed needles on said flexible element, the needles on said portion of said flexible element being oriented so that they point vertically upwardly and means for moving said portion of the flexible element and the adjacent transversely extending portion of the tubular stock vertically relative to each other for causing said portion of the tubular stock to be impaled on said needles.

24. The combination called for in claim 20 wherein the means for supporting said plate within the tubular stock comprises roller means fixed on said plate for rotation about an axis extending transversely of the plate, said roller means projecting from opposite faces of the plate and fixedly supported roller means separate from said plate and extending transversely on opposite sides thereof, said separate roller means engaging the roller means on the plate on the downstream side thereof, the plate being arranged within the tubular stock with one ply between one face of the plate and the adjacent separate roller means and the other ply between the other side of the plate and the adjacent separate roller means.

25. The combination called for in claim 20 wherein said plate is supported in a generally horizontal plane and the means for supporting the plate within the tubular stock comprises fixedly supported rollers separate from the plate and extending transversely on opposite sides thereof to support the plate therebetween, said plate being arranged within the tubular stock so that one ply thereof is disposed between one face of the plate and the adjacent roller and the other ply is disposed between the other face of the plate and the adjacent roller.

26. The combination called for in claim 25 including means for preventing the plate from shifting longitudinally relative to the heated element.

27. The combination called for in claim 23 including means for driving said flexible element to convey the blanks of tubular stock impaled on said needles in a direction transversely of the plate after they have been severed from the continuous length of tubular stock.

28. The combination called for in claim 27 including means downstream from said plate in the path of travel of the flexible element for securing together the two plies of the tubular blanks adjacent the severed edges thereof to form a closed end on the bag blank.

29. The combination called for in claim 28 wherein the bag blanks are permitted to hang vertically downwardly from said needles and including means located downstream from said plate in the path of travel of the flexible element for moving the needles and the portion of the blank suspended thereon vertically relative to each other to disengage the blank from the needles.

30. The combination called for in claim 29 including stacker means adjacent the path of travel of said flexible element and located downstream from said plate, said stacker means being swingable from a generally upright position adjacent the vertically supported tubular blanks toward the blank and to a generally horizontal position to stack the blanks horizontally one upon the other.

* * * * *